US008156883B2

(12) United States Patent
Sheedy et al.

(10) Patent No.: US 8,156,883 B2
(45) Date of Patent: Apr. 17, 2012

(54) BOAT BUMPER ASSEMBLY

(76) Inventors: Justin J. Sheedy, San Antonio, TX (US); James Scott White, San Antonio, TX (US)

( * ) Notice: Subject to any disclaimer, the term of this patent is extended or adjusted under 35 U.S.C. 154(b) by 1017 days.

(21) Appl. No.: 12/000,581

(22) Filed: Dec. 14, 2007

(65) Prior Publication Data

US 2009/0151615 A1 Jun. 18, 2009

(51) Int. Cl.
*B63B 59/02* (2006.01)

(52) U.S. Cl. ..... 114/219

(58) Field of Classification Search ..... 114/219, 114/220, 230.1, 230.2–230.29; 405/212–216; D12/167, 168, 317
See application file for complete search history.

(56) References Cited

U.S. PATENT DOCUMENTS 4,843,994 A * 7/1989 Wilson et al. ..... 114/219
5,048,446 A * 9/1991 Powell ..... 114/219
D353,355 S * 12/1994 Doyle ..... D12/168
D357,404 S * 4/1995 Doyle ..... D8/373
D364,595 S * 11/1995 Doyle ..... D12/168
D375,924 S * 11/1996 Kramer ..... D12/168
D378,508 S 3/1997 Kinkead
5,697,316 A 12/1997 Kinkead
D392,231 S * 3/1998 Vaughn ..... D12/168
6,349,661 B1 * 2/2002 Dusek ..... 114/219
6,637,360 B2 * 10/2003 Vretta ..... 114/219
D578,464 S * 10/2008 Sheedy et al. ..... D12/317
2004/0221788 A1 * 11/2004 Sievewright ..... 114/219

* cited by examiner

*Primary Examiner* — Ajay Vasudeva

(74) *Attorney, Agent, or Firm* — Bacon & Thomas, PLLC

(57) ABSTRACT

A boat bumper and a securing harness for mounting the boat bumper to a boat hull. The securing harness includes a main strap which is flexible and sufficiently stiff to be self sustaining to maintain its shape, and securing straps for securing a bumper roll to the main strap. The main strap has an elongated section and at least one generally transverse section. Each section has at least one free end to which a suction cup is releasably attached.

3 Claims, 3 Drawing Sheets

BOAT BUMPER ASSEMBLY

TECHNICAL FIELD

The field of this invention is boats, and a unique assembly used to protect the boat when it is being docked, or even brought along side another boat to prevent mutual damage.

BACKGROUND DISCUSSION

Boats, or watercraft, come in many sizes. Frequently it becomes necessary to secure the boat to a dock. The procedure can create a danger for the boat and personnel. The boat can collide with the dock causing damage to the boat and/or the dock.

Bumper rolls have been developed to act as shock absorbers to protect the boat and the dock during the docking maneuver. One such arrangement is shown, for example, in U.S. Pat. No. 5,048,446. In this patent the bumper is referred to as a fender. The fender is secured by straps and a strap member secures the fender to a post in or on the boat. The strap member has no self-sustaining rigidity and is foldable so that the secured fender is movable relative to the boat hull. Accordingly, movement of the fender is possible even after it is secured to the post in or on the boat.

The problem that arises with this arrangement is that the driver of the boat cannot always be certain of the location of the fender during the docking procedure since the fender is free to being displaced, for example, by poor driving or even wave motion on the boat. The use of fenders such as shown in the U.S. Pat. No. 5,048,446 patent is common and effective when the fender is located to absorb the impact with the dock, but clearly useless for this purpose when it does not.

In U.S. Pat. No. 5,697,316, the problem of fender displacement is less of a problem because the bumper comprises a plate attached to the boat hull by suction cups. The fender comprises one or more strips of padding secured to the plate. The forces created by impact with a dock must first be reacted by the plate and from the plate to the padded strips. The rigidity of the plate can dislodge the suction cups because the plates are stiff and the impact load spreads throughout the plate. Even though there are strips of padding these strips will not absorb all the impact load because they are secondary force reactors with the primary force reactor being the plate.

What is needed is a bumper assembly where soft rolls are used such as the bumper fender of the U.S. Pat. No. 5,048,446 patent, but arranged so that they are fixed such that the soft roll is the primary force absorber. The present invention provides such an assembly.

SUMMARY

A boat bumper assembly is intended to assume varied fixed locations on the outside surface of the boat hull. This arrangement allows for great flexibility in where and how the assembly is placed when it is needed. It is easily attached to the boat hull and just as easily removed when desired.

The assembly has a mounting bracket and a bumper roll (fender) which is attached to the mounting bracket. The mounting bracket includes fasteners which allows the bracket to be attached to the outside surface of the boat hull at any selected location. It also includes securing members used to secure the bumper roll to the mounting bracket.

The boat bumper assembly described above is preferred to those which merely mount the bumper pad to the boat loosely. That is, without it being secured against movement when encountering the dock. When the boat bumper assembly described above is employed, the driver rests secured that the bumper roll or pad will be the primary force absorber and that it will not move once it is set relative to the hull of the boat.

The boat bumper assembly has significant flexibility in where and how it is mounted to the boat hull. It is also flexible, but yet sufficiently stiff so that it can be configured as desired to fit the contour of the boat hull and have sufficient rigidity to withstand the loads that the bumper pad is subjected to. Impact loads will not dislodge the assembly from its mounted location.

The material of the securing harness can be varied. That is, it can be metal or plastic. The important consideration is that it be flexible so that it can be bent, for example, but also sufficiently stiff so that it can withstand impact loads.

BRIEF DESCRIPTION OF THE DRAWINGS

Seven (7) figures have been selected to illustrate the invention via several exemplary embodiments. These are.

DETAILED DESCRIPTION OF THE ILLUSTRATED EMBODIMENTS

Figure 1:
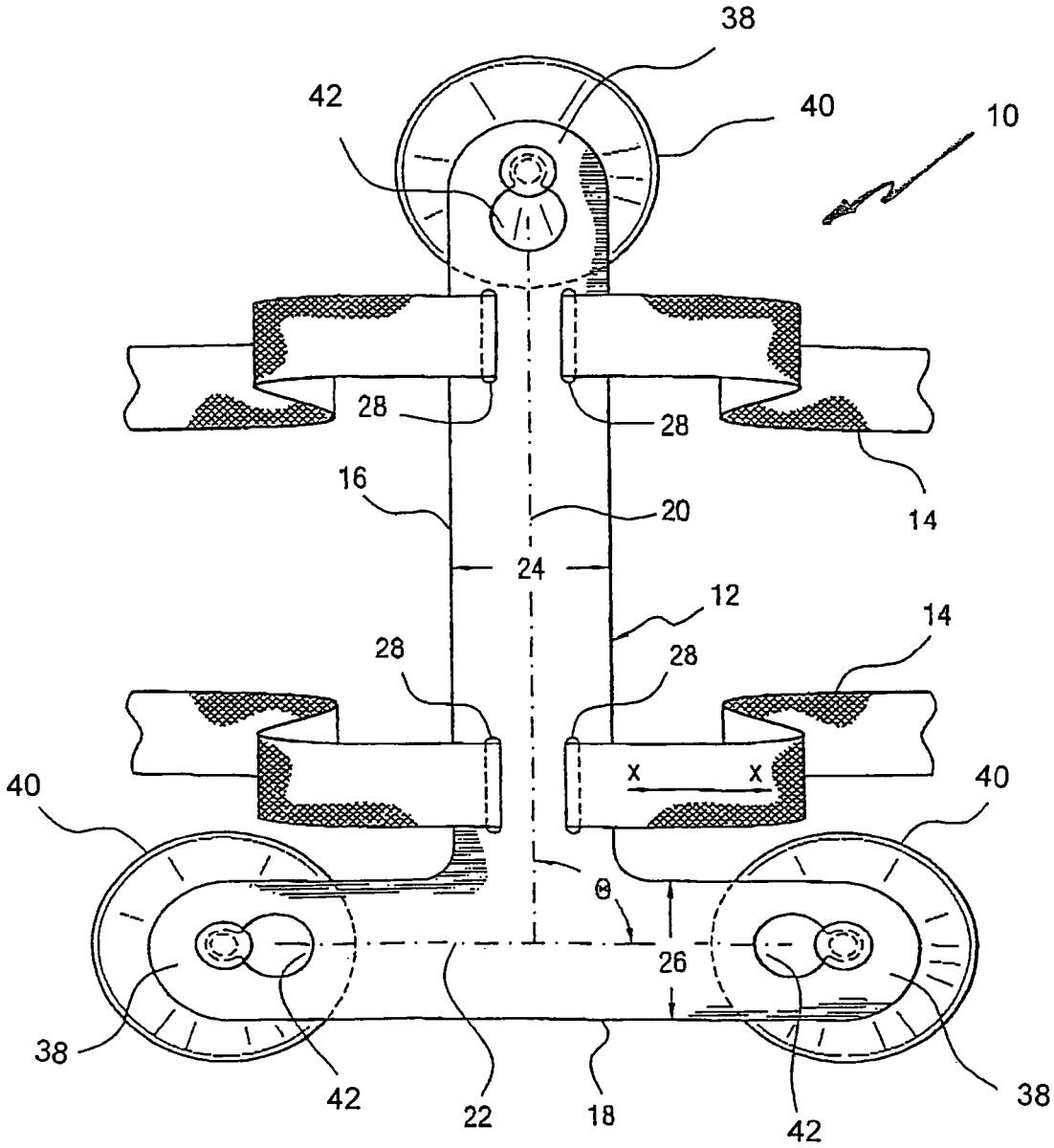
FIG. 1: a planar view of one embodiment of the main strap of the securing harness according to the present invention.
Figure 2:
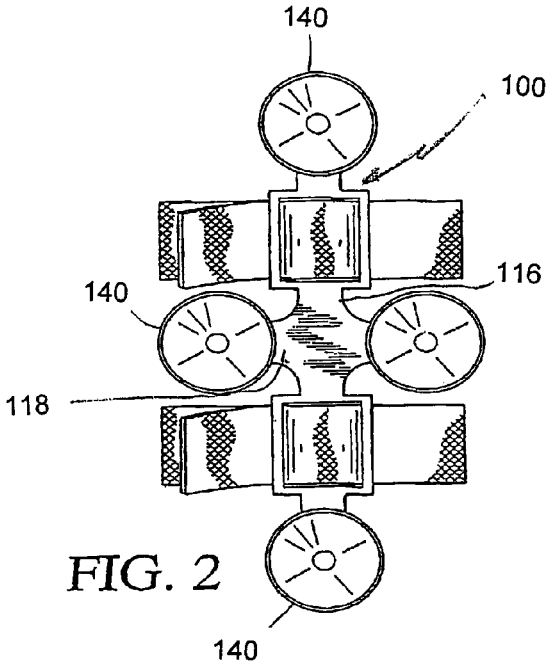
FIG. 2: a planar view, to a smaller scale than that of FIG. 1, of another embodiment of the securing harness according to the present invention.
Figure 3:
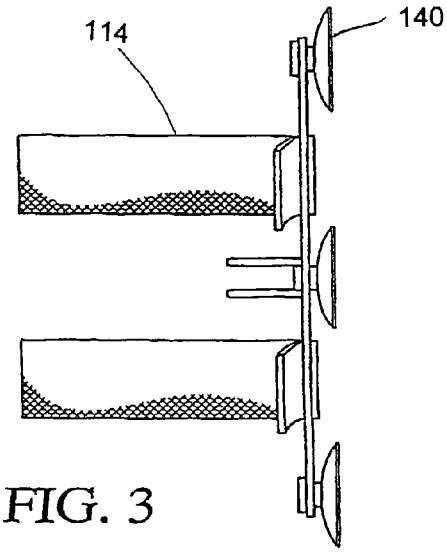
FIG. 3: a side view of the securing harness of FIG. 2.

In FIG. 1 there is shown one embodiment of a securing harness 10 including a main strap 12 and two releasably securing straps 14. Two securing straps 14 are shown, but it should be understood that more or less than two is possible.

The main strap 12 comprises an elongated section 16, shown oriented vertically in FIG. 1 to which a generally transverse section 18 is attached at one end. The generally transverse section 18 is shown horizontally in FIG. 1. While a single generally transverse section 18 is shown in FIG. 1, it should be understood that such a generally transverse section 18 can be attached at each end of the elongated section 16, or even between the two ends, or still further at each end and between the ends. Each elongated section 16 and each generally transverse section 18 define an elongated axis 20 and 22, respectively, which form any angle θ between them. The angle θ shown in FIG. 1 is 90°. The angle θ for the generally transverse section 18 that would be attached at the other end of the main elongated section 16 can be 90° also, or some other angle, greater or less than 90°. It is also possible for more than one generally transverse section 18 to be employed with the corresponding angle θ equal or unequal to each other. The width 24 of the elongated section 16 and the width 26 of the generally transverse section 18 can be the same or different.

Figure 4:
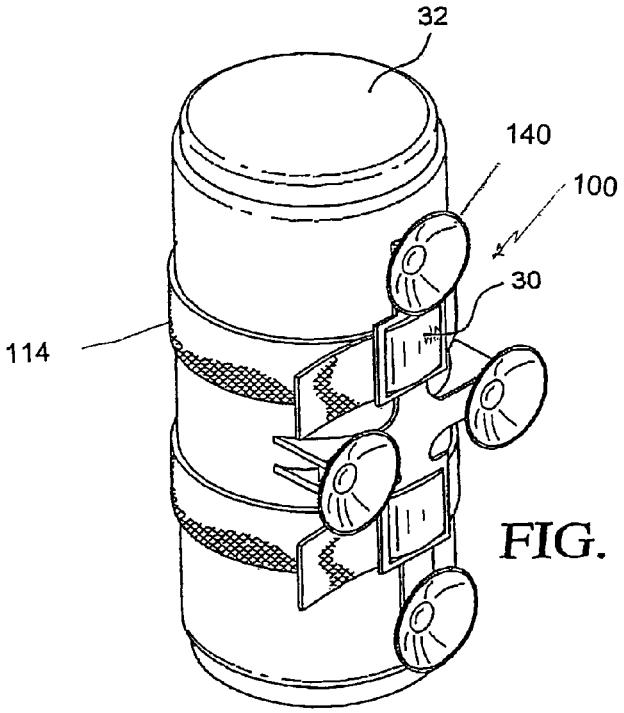
FIG. 4: a perspective view of the boat bumper assembly with the securing harness of FIG. 2.
Figure 5:
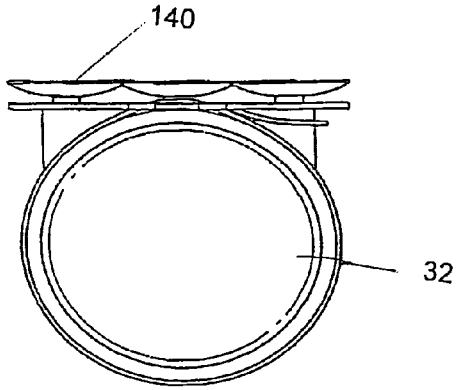
FIG. 5: a top view of the boat bumper assembly of FIG. 4.
Figure 6:
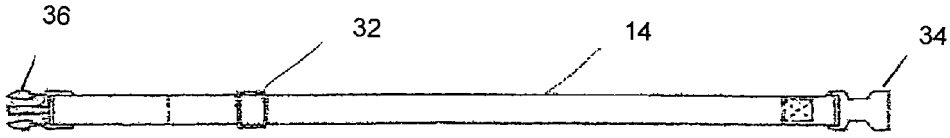
FIG. 6: a planar view of the releasably securing strap.

The elongated section 16 is provided with a set of slots 28 through which the releasably securing straps 14 pass. Each releasably securing strap 14 can then be adjusted in the direction X-X. At the ends of each releasably securing strap 14 is arranged a mutual joining structure, such as a buckle 30 (FIG. 4), or some other joining mechanism. In this way an appropriately sized releasably secured strap 14 can be available to secure any size bumper roll 32 (FIG. 4). For example, in FIG. 6, the releasably securing strap 14 has a length adjusting buckle 32, a lock housing 34 at one end and a key 36 at the other end, which is received in the housing 34.

As shown in FIG. 1, the securing harness 10 has three free ends 38 to which a suction cup 40 is attached. While the securing harness 10 shown in FIG. 1 has three free ends, it should be understood that more than three free ends could be provided depending on the number of generally transverse sections 18 employed. The suction cups 40 can be fixed to their respective free ends, or they can be attached to be readily removed. For this purpose the free ends include an I-slot 42. In a known manner the larger opening of the I-slot receives a pin extending from the suction cup 40. The suction cup 40 is then moved into the smaller opening of the slot where it is secured.

Figure 7:
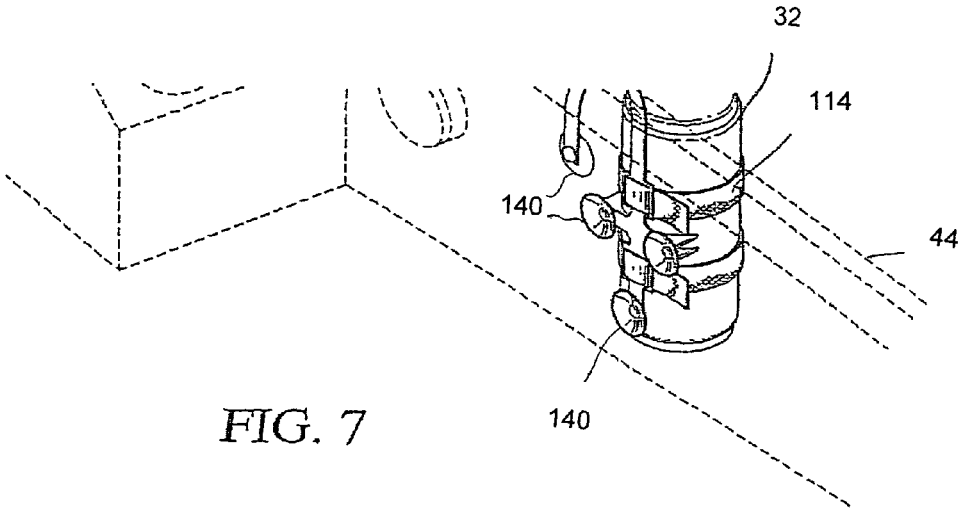
FIG. 7: a view showing a boat bumper assembly using the securing harness including the main strap of FIG. 1 mounted to the hull of a boat.

The securing harness 10 is preferably made from a resilient material which allows the securing harness to bend without destruction. There are any number of materials which will meet this condition, including metal. While the material is desirably resilient, it must also be stiff and be able to absorb impact loads applied to the bumper roll which is secured to the securing harness 10. For example, as shown in FIG. 7, the securing harness may be required to bend to fit the peculiar shape of the boat's hull 44. The greater the contour of the boat's hull, the more resiliency may be needed. The point is that the securing harness 10 is sufficiently resilient so that either side of the generally transverse section 18 can be bent relative to the other side, and that a portion of the elongated section 16 can be bent relative to the remainder of the elongated section 16. In any case, the securing harness 10 must have, as noted above, sufficient stiffness so that the impact loads received by the bumper roll 32 can be transferred through the securing harness 10 and the suction cups 40 to the hull 44 of the boat.

An alternative embodiment is shown in FIGS. 2-5. The securing harness 100 includes an elongated section 116 with a generally transverse section 118 located at approximately the midplane between the two ends of the elongated section 116. Each free end of the sections 116 and 118 contains a suction cup 140. The suction cups 140 are connected as are the suction cups 40. Again, the angle θ is formed and it can be any desired value. Releasable securing straps 114 are included. These are similar to releasable securing straps 14. Note the assembly shown in FIG. 4 which demonstrates how the bumper roll 32 is secured to the securing harness 100.

The boat bumper assembly shown and described has proven effective in use. It is easily assembled and attached to a boat and once attached it remains in place and is not dislodged at impact.

What is claimed is:

1. A boat bumper assembly, comprising:

a bumper roll capable of absorbing force; and a securing harness, wherein:

said securing harness has a main strap, securing straps for securing said bumper roll to said main strap and at least two releasable securing means; and said securing means releasably attaches said securing harness with said securing means and said bumper roll to the hull of a boat, wherein:

said main strap is flexible and sufficiently stiff to be self-sustaining to maintain its shape;

said main strap includes an elongated section and at least one generally transverse section;

said elongated section includes at least one set of two spaced apart slots through which a selected one of said securing straps passes for adjuatable mounting to said elongated section; and each securing strap has a longitudinal extent and is adjustable in length along said longitudinal extent.

2. The boat bumper assembly as defined in claim 1, wherein:

said elongated section has at least one free end to which said securing means is attached; and said generally transverse section has two free ends to each of which said securing means is attached.

3. A boat bumper assembly, comprising:

a bumper roll capable of absorbing force; and a securing harness, wherein:

said securing harness has a main strap, securing straps for securing said bumper roll to said main strap and at least two releasable securing means; and said securing means releasably attaches said securing harness with said securing means and said bumper roll to the hull of a boat, wherein:

said main strap is flexible and sufficiently stiff to be self-sustaining to maintain its shape;

said main strap includes an elongated section and at least one generally transverse section;

said elongated section has at least one free end to which one of said at least two releasable securing means is attached;

said generally transverse section has two free ends to each of which one of said at least two releasable securing means is attached; and said securing means comprise suction cups which are releasably attached to their respective elongated section and said generally transverse section.

* * * * *